US006381441B1

(12) United States Patent
Byeon et al.

(10) Patent No.: US 6,381,441 B1
(45) Date of Patent: Apr. 30, 2002

(54) METHOD FOR CONTROLLING PAPER FEEDING OF A LIQUID ELECTROPHOTOGRAPHIC COLOR PRINTING DEVICE

(75) Inventors: Sang-Hyeon Byeon; Nam-Ryoung Kim, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/635,780

(22) Filed: Aug. 11, 2000

(30) Foreign Application Priority Data

Nov. 20, 1999 (KR) ..... 99/51741

(51) Int. Cl.[7] ..... G03G 15/00

(52) U.S. Cl. ..... 399/396; 271/3.16; 271/265.02; 399/18; 399/21

(58) Field of Search ..... 399/16, 18, 19, 399/21, 43, 388, 390, 391, 394, 396; 271/3.16, 227, 258.01, 259, 265.01, 265.02

(56) References Cited

U.S. PATENT DOCUMENTS 3,948,510 A 4/1976 Iwamoto et al. ..... 271/258.03
5,018,718 A * 5/1991 Matsuno et al. ..... 399/16 X
5,365,322 A 11/1994 Hamada et al. ..... 399/21
5,534,976 A 7/1996 Kim ..... 399/18
5,580,046 A 12/1996 Beaufort et al. ..... 271/3.16
5,678,123 A * 10/1997 Kim ..... 399/21
5,713,059 A 1/1998 Ishikawa ..... 399/18
5,822,668 A 10/1998 Fromm et al. ..... 399/323
5,826,157 A * 10/1998 Wierszewski ..... 399/396
5,943,524 A * 8/1999 Eom ..... 399/18
5,963,754 A 10/1999 Itoh et al. ..... 399/21

FOREIGN PATENT DOCUMENTS

JP 2000-143040 * 5/2000

* cited by examiner

*Primary Examiner*—Sophia S. Chen

(57) ABSTRACT

A paper feeding control method for compensating the rotational speed of a paper feeding roller by varying the rotational speed appropriately according to the paper feed delay when detecting the presence of the paper feed delay on a paper feeding path of a liquid electrophotographic color printing device. The paper feeding control method measures the time taken for a paper to be fed on the paper feeding path to a certain part of the feeding path, and determines the presence and degree of the paper delayed at the certain part by comparing the measured time at the certain part with a preset paper feeding time for the certain part. Next, according to the determination made, the method adjusts the rotational speed of the driving motor for driving the paper feeding roller to increase the rotational speed of the paper feeding roller, and to compensate for the paper feed delay. Accordingly, the frequency of paper jamming occurrence due to the paper feed delay is decreased, and the paper curl occurs steadily, and also the papers are kept at uniform intervals. As a result, the deterioration of the print quality is prevented.

20 Claims, 4 Drawing Sheets

METHOD FOR CONTROLLING PAPER FEEDING OF A LIQUID ELECTROPHOTOGRAPHIC COLOR PRINTING DEVICE

CLAIM OF PRIORITY

This application makes reference to, incorporates the same herein, and claims all benefits accruing under 35 U.S.C. §119 from an application entitled Method for Controlling Paper Feed of a Liquid Electrophotographic Color Printer earlier filed in the Korean Industrial Property Office on Nov. 20, 1999, and there duly assigned Ser. No. 99-51741 by that Office.

BACKGROUND OF THE INVENTION

1. Field of the Invention

The present invention relates to a method for controlling paper feeding of a liquid electrophotographic color printing device, and more particularly, to a method for controlling the paper feeding of a liquid electrophotographic color printing device capable of minimizing the occurrence of a paper jam by variably adjusting the speed of the paper feeding roller in accordance with the delay period when the paper feeding is delayed at a paper feeding path.

2. Description of the Background Art

In general, a liquid electrophotographic color printing device prints an image by forming an electrostatic latent image on a photosensitive medium such as a photosensitive belt by projecting a laser beam, developing the electrostatic latent image by using a developer in which a solid toner having a certain color is mixed with a carrier serving as solution for the toner, and transferring the image onto a paper. The image is transferred onto the paper around a transfer unit.

The electrostatic printer will have multiple sensors located around the paper feeding path. The sensors allow the printer to monitor if there is any delay in the paper moving along the paper path. If there is a delay at any point, the printer stops the movement of the paper along the paper path until the problem is corrected.

In case of a paper feeding delay, by detecting such a feeding delay of the paper and by accordingly stopping the paper feeding, the print quality deterioration caused due to the feeding delay is prevented.

The paper feed controlling method of the conventional liquid electrophotographic color printing device as described above, however, simply stops the feeding operation while simultaneously displaying the jamming error whenever detecting the paper feed delay on the paper feed path, and accordingly has a drawback of frequent stoppage of printing operation when the jamming frequently occurs. More specifically, in the liquid electrophotographic color printing device, the printing operation is frequently stopped by the jamming errors, when the paper feed delay occurs due to other reasons such as the slipping of the rollers, the operation delay of the clutches, the mis-picking of the paper, or the troubles on the paper feed path.

Moreover, in the conventional liquid electrophotographic color printing device having a long paper feed path, during a continuous printing of letter papers on the paper feed path, multiple sheets of letter paper should be simultaneously fed on the paper feed path at uniform intervals and also with stable paper curl at the last paper feeding roller closest to the transfer unit in order to prevent printing quality deterioration. However, in the conventional printing device, it is hard to keep sheets of letter paper at uniform intervals since paper feed delays frequently occur due to the above reasons. Moreover, the unstable occurrence of the paper curl at the last paper feeding roller also deteriorates print quality.

Exemplars of the background art, U.S. Pat. No. 5,713,059 for Paper Jam Detector for Electrophotographic Printer issued to Ishikawa, U.S. Pat. No. 5,534,976 for Method for Eliminating a Paper of an Image Forming System and Apparatus Therefor issued to Kim, U.S. Pat. No. 5,580,046 for Selective Ejection of Sensed Paper Jams in Single Sheet Paper Processing Equipment issued to Beaufort et al., U.S. Pat. No. 5,822,668 for Fuser Subsystem Module for an Electrophotographic Printer Which Pivots Open for Jam Clearance issued to Fromm et al., U.S. Pat. No. 3,948,510 for Sheet Jam Detector for Electrophotographic Copying Machine issued to Iwamoto et al., U.S. Pat. No. 5,365,322 for Image Forming Apparatus Which Detects a Jam of a Wound Sheet issued to Hamada et al., U.S. Pat. No. 5,963,754 for Medium Detection Unit, Medium Conveyance Apparatus and Image Formation System Including a Single Sensor Which Detects Medium Passage, a Fully Accumulated Condition and a Jam Condition issued to Itoh et al. disclose paper jam detectors for electrophotographic printing devices. I have found that the art does not show a way to minimize the occurrence of paper jams.

SUMMARY OF THE INVENTION

The present invention has been developed to overcome the above mentioned problems of the art, and accordingly it is an object of the present invention to provide a paper feed controlling method of a liquid electrophotographic color printing device for minimizing the occurrence of a paper jam by compensating a paper feed delay when the delay occurs on a paper feeding path, for controlling steady occurrence of paper curl during a continuous printing of multiple letter papers, and for maintaining letter papers at uniform intervals.

It is another object to have a paper jam monitor that can avoid multiple stoppages of the transfer of paper through an electrophotographic printer.

It is a further object to have an electrophotographic printer that can rapidly print on paper while minimizing paper jams.

It is yet another object to have a method of adjusting the transfer rate of the paper through a paper path according to any delay of the paper transporting through the paper path.

It is yet a further object to have a printer that can effectively minimize the occurrence of paper jams in a printer that has a long paper path and handles multiple types of papers.

Accordingly, to achieve the above object, the present invention provides a paper feed control method of a printing device including picking up a sheet of paper accommodated in a paper cassette and forwarding the paper to a paper feeding path formed between the paper cassette and a transfer/securing unit of the printing device; feeding the paper forwarded to the paper feeding path; detecting the feed speed of the paper being fed along the paper feeding path; determining whether the paper is delayed or not in accordance with the result of the step of detecting the feed speed; and compensating the feed speed of the paper by increasing the feed speed when the paper is determined to be delayed.

The above object is also accomplished by a paper feed control method of a paper feeding device of a liquid electrophotographic color printing device having a multiple paper cassettes for accommodating various sizes and types of paper; a pickup roller assembly for picking a sheet of the paper from the paper cassettes and forwarding the paper to a paper feeding path; a first, a second, a third, a fourth, and a fifth paper feeding rollers arranged in pairs at certain intervals on the paper feeding path, for feeding the paper; first and second driving motors for driving the first, second, third, fourth, and fifth paper feeding rollers and the pickup roller assembly; multiple first clutches for selectively connecting the first driving motor with the pickup roller assembly, the first paper feeding roller, or the second paper feeding roller; multiple second clutches for selectively connecting the second driving motor with the third paper feeding roller, the fourth paper feeding roller, or the fifth paper feeding roller; and first, second, third, fourth, and fifth jamming detecting sensors, installed adjacent to the first, second, third, fourth, and fifth paper feeding rollers, for detecting the paper passing there through. The paper feed control method first detects the feeding speed of the paper being passed through the respective paper feeding rollers by the first through the fifth jamming detecting sensors. This step measures the time right after the driving of the first paper feeding roller until the paper arrives at the third jamming detecting sensor. Secondly, the presence of a paper delay is determined in accordance with the detected result in the step of detecting the feeding speed. The second step determines the paper feed delay when the paper arrival time at a certain part is later than the preset paper feeding time for the certain part by comparing the paper arrival time at the certain part detected by the third jamming detecting sensor with the preset paper feeding time for the certain part. Thirdly, the paper feed delay is compensated by adjusting the rotational speed of the paper feeding rollers according to the determined paper feed delay. The final step adjusts the rotational speed of the second driving motor to vary the rotational speed of a paper feeding roller which is driven by the second driving motor.

The paper feed control method further includes an additional step of returning the adjusted rotational speed of the second driving motor to the initial rotational speed after driving the second driving motor at the adjusted rotational speed for a certain length of time. Here, the rotational speed of the second driving motor is returned to the initial rotational speed when the paper is detected by the fifth jamming detecting sensor.

According to the features of the present invention, since the rotational speed of the corresponding paper feeding roller is compensated to be varied based on the degree of the paper feed delay without stopping the paper feeding even when the paper feed delay is detected on the paper feeding path, the frequency of the paper jamming can be decreased. Accordingly, frequent interruptions of the printing job due to the jamming error are prevented. Further, since the occurrence of paper curl at the fifth paper feed roller is consistently controlled, and since the papers are kept at uniform intervals during continuous printing operation, the deterioration of the print quality can be prevented.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
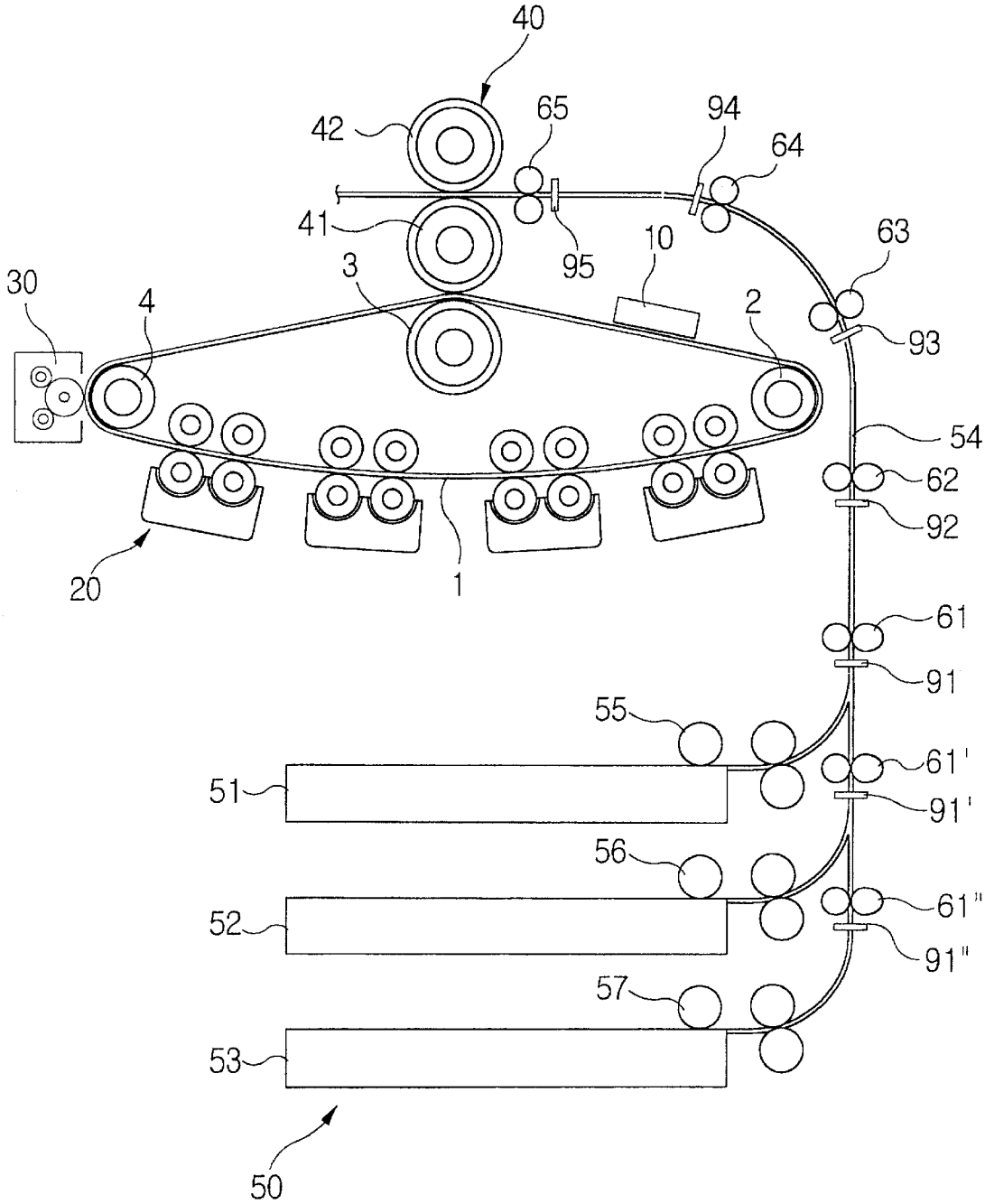
FIG. 1 is a schematic view showing a paper feeding device of a liquid electrophotographic color printing device.

Turning now to the drawings, as shown in FIG. 1, the printing device includes a belt-type photosensitive medium 1 that rotatably drives on a certain track wound around rollers 2, 3, and 4 that are installed in a main body (not shown) of the printing device. An electrostatic charge unit 10, an exposure unit (not shown), a developing unit 20, a drying unit 30, and a transfer/securing unit 40 are respectively installed at a neighboring position with respect to the photosensitive medium 1.

The electrostatic latent image is formed on the photosensitive medium 1 by the exposure unit. The electrostatic latent image is then developed by the developing unit 20. The developing unit 20 injects the developer onto the photosensitive medium 1 while only the toner of the developer remains on the electrostatic latent image formed on the photosensitive medium 1 so that the electrostatic latent image on the photosensitive medium 1 is developed. The drying unit 30 removes remaining carriers on the electrostatic latent image that are not removed by the developing unit 20 up to a level which the developed image can be transferred by the transfer/securing unit 40. Then the transfer/securing unit 40 transfers the developed image on the photosensitive medium 1 to the paper. Meanwhile, the paper is sequently fed towards the transfer/securing unit 40 by a paper feeding device 50.

Figure 2:
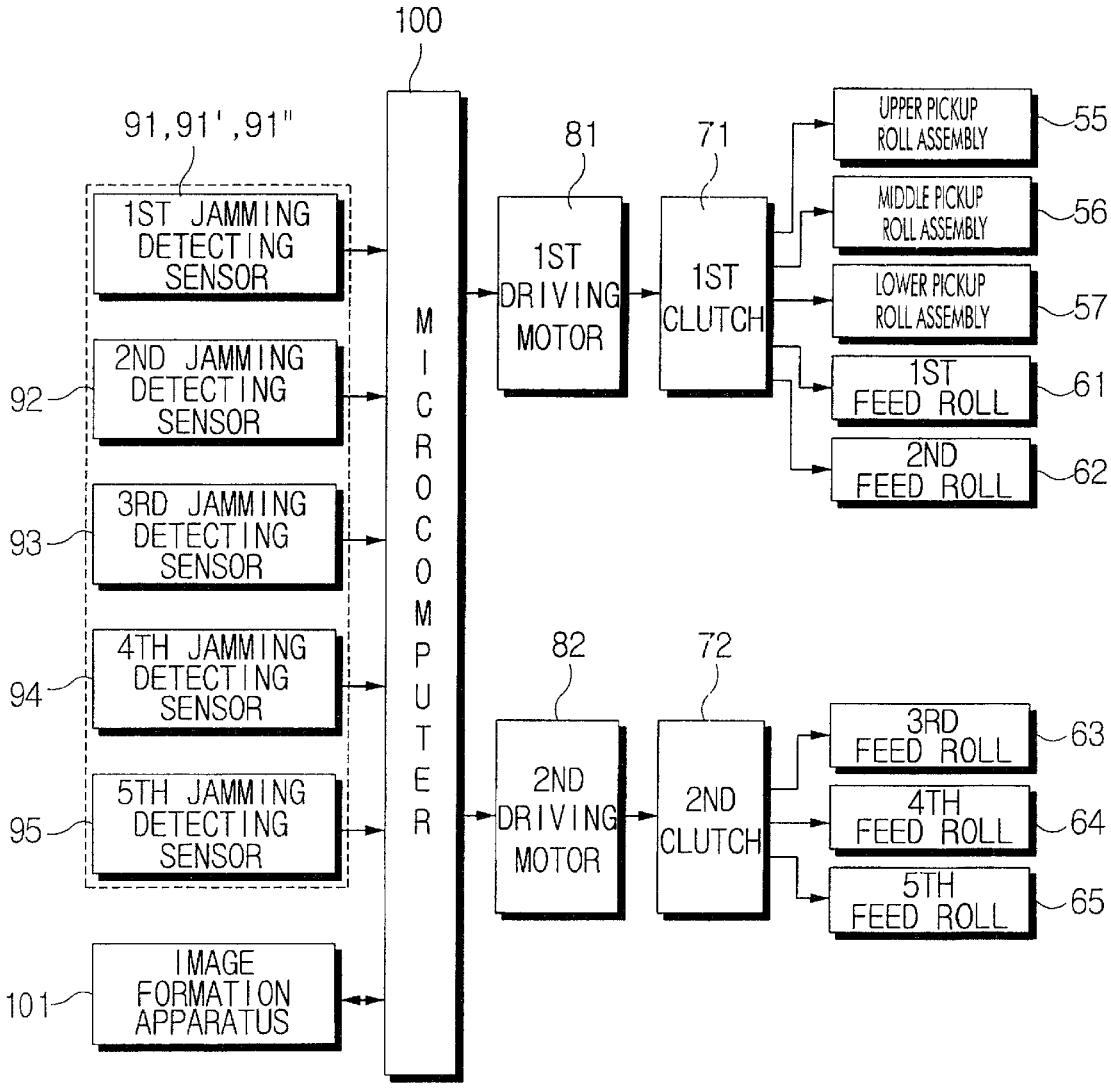
FIG. 2 is a block diagram of a paper feed control unit of a liquid electrophotographic color printing device.

The paper feeding device 50, as shown in FIGS. 1 and 2, includes multiple cassettes 51, 52, 53 for accommodating the papers according to sizes and types, and a paper feeding path 54 for guiding the feeding of papers, which is formed from the cassettes 51, 52, and 53 along to the transfer and securing unit 40.

At the rear sides of the cassettes 51, 52, and 53, multiple pickup roller assemblies 55, 56, and 57 are disposed for picking up the papers held in multiple cassettes 51, 52, and 53 and for forwarding the papers into the paper feeding path 54. Multiple pairs of paper feeding rollers 61, 62, 63, 64, and 65 are installed on the paper feeding path 54 at certain intervals.

The pickup roller assemblies 55, 56, and 57 and the first and second paper feeding rollers 61 and 62 are selectively connected to a first driving motor 81 by multiple first clutches 71 and are selectively driven by the first driving motor 81, while the third, fourth, and fifth paper feeding rollers 63, 64, and 65 are selectively connected to a second driving motor 82 by multiple second clutches 72 and are selectively driven by the second driving motor 82. The driving power of the first and second driving motors 81 and 82 is selectively transmitted to the corresponding pickup roller assemblies 55, 56, and 57 and the paper feeding rollers 61, 62, 63, 64, and 65 by the ON/OFF operation of the first and second clutches 71 and 72, so that a sheet of the paper in the cassettes 51, 52, and 53 is fed to the transfer/securing unit 40 along the paper feeding path 54. Here, the first paper feeding roller 61 also serves the function of initially aligning the leading edge of the paper which is picked up from the cassette 51 to be fed, and the fifth paper feeding roller 65 also serves the function of finally aligning the leading edge of the paper in front of the transfer/securing unit 40.

Moreover, at a neighboring position of the respective paper feeding rollers 61 to 65 on the paper feeding path 54, multiple jamming detecting sensors 91, 92, 93, 94, and 95 are installed while to being electrically connected with a microcomputer 100.

In addition to its function to control the image formation apparatus 101, the microcomputer 100 also controls the operation of the respective rollers such as the pickup roller assemblies 55, 56, and 57, and the paper feeding rollers 61, 62, 63, 64, and 65 in a manner of determining a paper jam by the data received from the jamming detecting sensors 91, 92, 93, 94, and 95. In other words, the microcomputer 100 detects the paper arrival time in the respective parts by using the jamming detecting sensors 91, 92, 93, 94, and 95, and determines as paper jam when the paper arrives after a predetermined time which is inclusive of a jamming check margin, and accordingly stops the paper feeding. Here, the jamming check margin is 10 mm. Unexplained reference numerals 61' and 91' represent a first paper feeding roller and a first jamming detecting sensor used when the mid-cassette 52 is in use, and 61" and 91" are a first paper feeding roller and a first jamming detecting sensor that are used when the lower cassette 53 is in use.

According to the paper feeding device of the printing device as constructed above, one sheet of the paper is picked up from the corresponding cassette 51 by the pickup roller assembly 55 and forwarded in the paper feeding path 54. The paper is fed toward the transfer/securing unit 40 by multiple paper feeding rollers 61, 62, 63, 64, and 65. At this time, the fifth paper feeding roller 65 finally aligns and forwards the paper to go between a transfer roller 41 and a securing roller 42 for the stable printing performance, and accordingly, the transferred image from the photosensitive medium 1 onto the transfer roller 41 is printed onto the aligned paper.

In order for the image of the transfer roller 41 to be transferred onto the paper safely, the paper should be fed to the transfer roller 41 while having a certain margin between respective ends of the image and the paper (5 mm for example). For this purpose, the microcomputer 100 controls the operation of multiple first and second clutches 71 and 72 in a manner that the paper is picked up from the cassettes 51, 52, and 53 and is fed to the transfer roller 41 for a certain time period corresponding to the rotating time of the photosensitive medium 1, which is rotated from the leading end of the image formation to the transfer roller 41.

Figure 3:
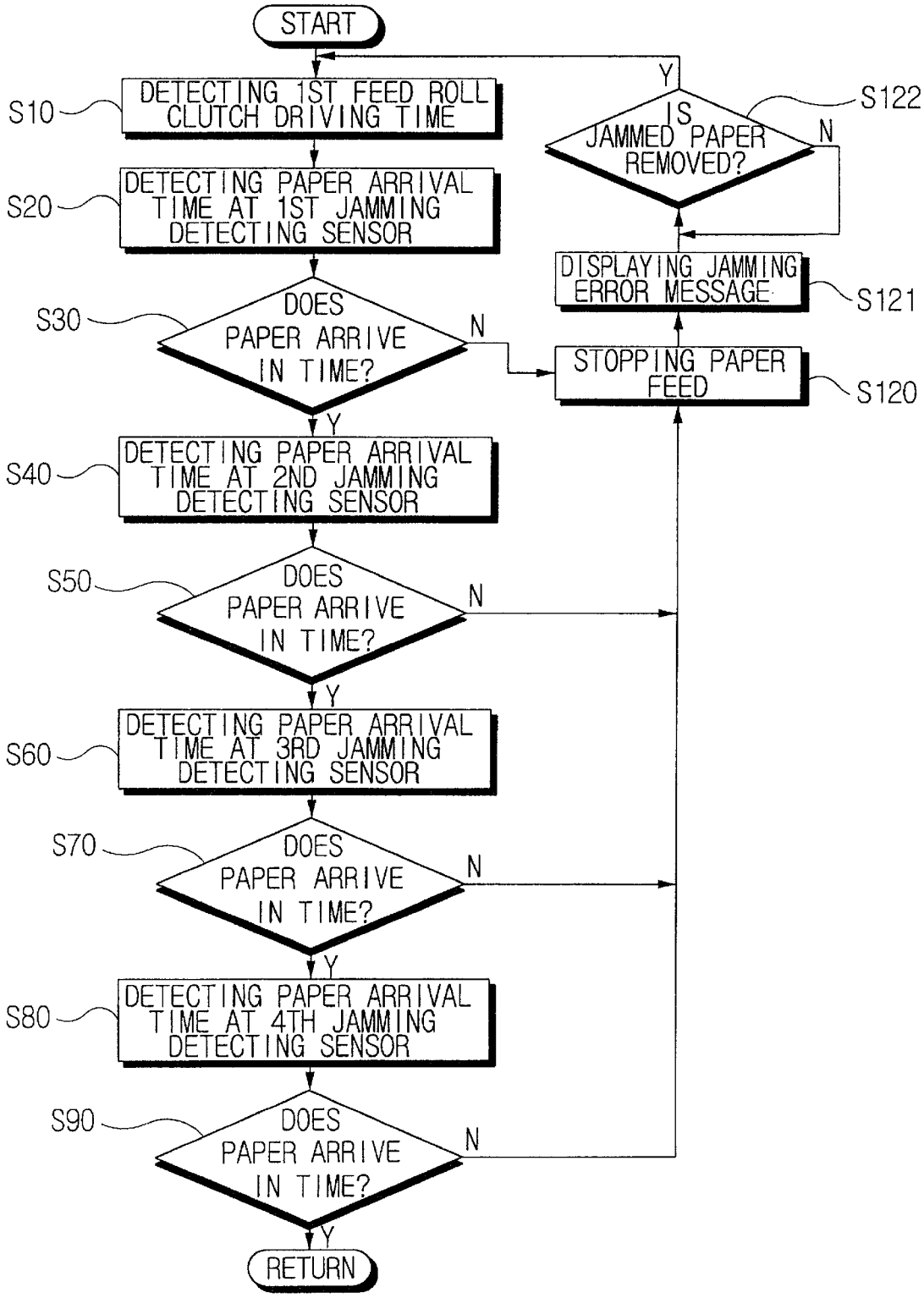
FIG. 3 is a flow chart for explaining a paper feed control method.

A paper feeding method in the printing device as constructed above, will be described in greater detail with reference to FIG. 3.

When a print start signal is applied, the microcomputer 100 drives the first and second driving motors 81 and 82 and connects the first clutch 71 to the pickup roller assembly 55 of the cassette 51 so as to pick up one sheet of the paper in the cassette 51, while simultaneously detecting the driving time of the first clutch 71 (Step S10). Next, the microcomputer 100 sequentially connects the plurality of second clutches 72 so as to feed the papers while simultaneously detecting the time from the first paper feeding roller 61 driving point to the paper arrival time at the first jamming detecting sensor 91 (Step S20). Then the detected result is determined (Step S30), and if the detected result indicates the paper has arrived within a preset time, the microcomputer 100 again detects the paper arrival time at the second jamming detecting sensor 92 (Step S40). If the paper is not detected by the first jamming detecting sensor 91 within the preset time, the microcomputer 100 determines it as a jamming error and stops the paper feeding (Step S120) and displays the jamming error sign (Step S121). If a user removes the jammed paper (Step S122), the microcomputer 100 restarts the printing job.

Meanwhile, the detected result of step S40 is determined (Step S50), and if the detected result indicates the paper has arrived within the preset time, the microcomputer 100 again detects the paper arrival time at the third jamming detecting sensor 93 (Step S60). If the paper is not detected by the second jamming detecting sensor 92 within the preset time, the microcomputer 100 determines it as a jamming error and stops the paper feeding (Step S120) and displays the jamming error sign (Step S121). If a user removes the jammed paper (Step S122), the microcomputer 100 restarts the printing job.

Further, the detected result of step S60 is determined (Step S70), and if the detected result indicates the paper has arrived within the preset time, the microcomputer 100 again detects the paper arrival time at the fourth jamming detecting sensor 94 (Step S80). If the paper is not detected by the third jamming detecting sensor 93 within the preset time, the microcomputer 100 determines it as a jamming error and stops the paper feeding (Step S120) and displays the jamming error sign (Step S121). If a user removes the jammed paper (Step S122), the microcomputer 100 restarts the printing job.

Furthermore, the detected result of step S80 is determined (Step S90), and if the detected result indicates the paper has arrived within the preset time, the microcomputer 100 again detects the paper arrival time at the fourth jamming detecting sensor 94. If the paper is not detected by the fourth jamming detecting sensor 94 within the preset time, the microcomputer 100 determines it as a jamming error and stops the paper feeding (Step S120) and displays the jamming error sign (Step S121). If a user removes the jammed paper (Step S122), the microcomputer 100 restarts the printing job.

The fifth jamming detecting sensor 95 performs the same processes as the above-described processes (Steps S80–S90 and S120–S123). Accordingly, the description of the operation of the fifth jamming detecting sensor 95 will be omitted.

Here, the preset times of the respective parts are determined by considering the speed of the respective rollers 55–57 and 61–65, i.e., the rotating speed of the motors 81 and 82 connected to the respective rollers 55–57 and 61–65 via the clutches, the distances between the respective jamming detecting sensors 91–95, the margin between the respective leading ends of the image and the paper, and a margin provided in case of a curl occurrence. The preset times are pre-stored in the microcomputer 100.

Figure 4:
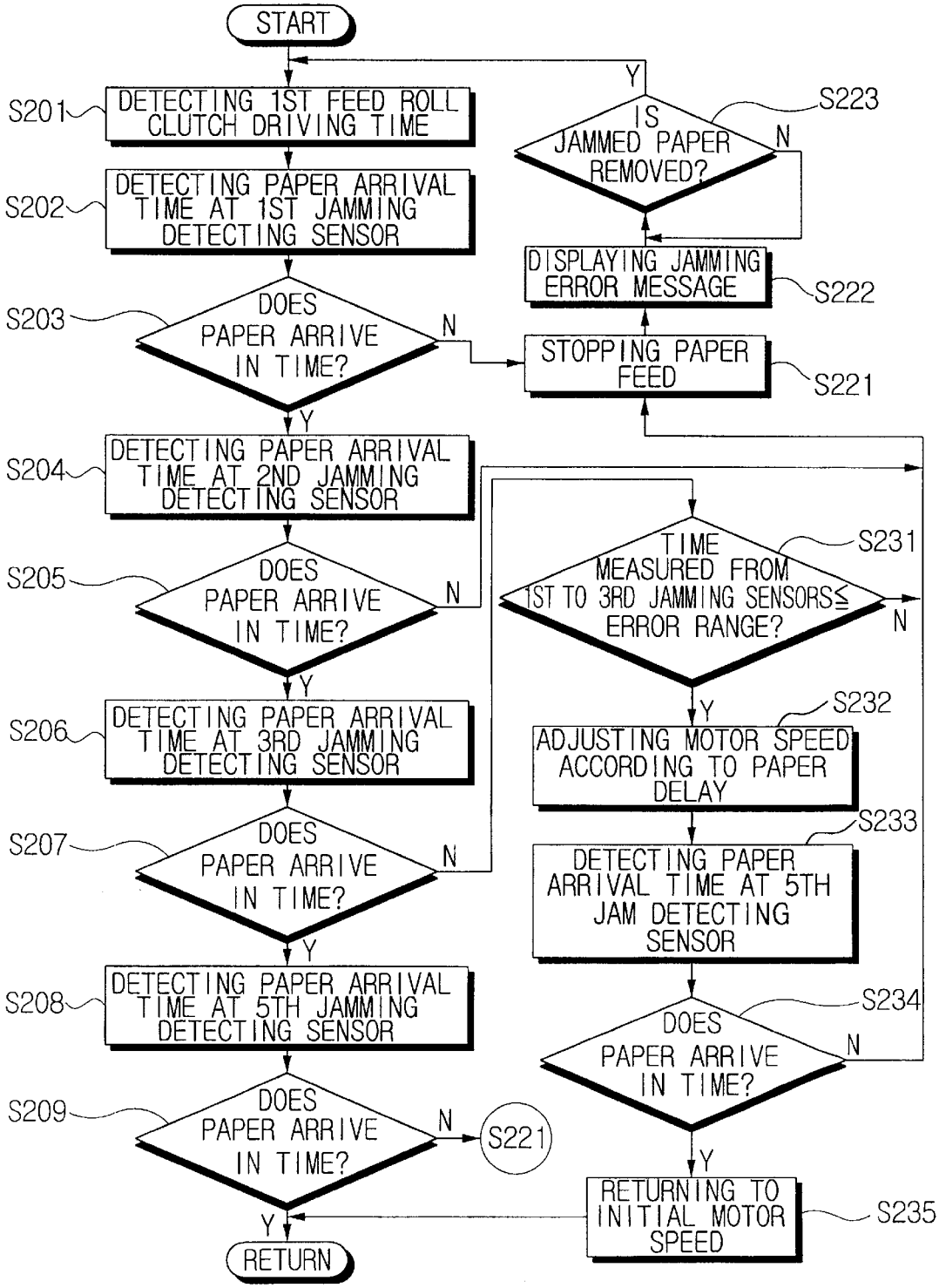
FIG. 4 is a flow chart for explaining a paper feed control method of a liquid electrophotographic color printing device according to a preferred embodiment of the present invention.

FIG. 4 is a flow chart for showing a paper feed control method of a liquid electrophotographic color printing device according to a preferred embodiment of the present invention. Since the construction of a paper feeding unit of a printing device to which the paper feed control method of the present invention is applied, is the same as the above, the construction of the paper feeding device will be described with reference to FIGS. 1 and 2.

At the rear sides of the cassettes 51, 52, and 53, as shown in FIG. 1, multiple pickup roller assemblies 55, 56, and 57 are installed to pick up the paper contained in the corresponding paper cassettes 51, 52, and 53 and forward the paper into the paper feeding path 54. The first, second, third, fourth, and fifth paper feeding rollers 61, 62, 63, 64, and 65 are installed in pairs on the paper feeding path 54 at certain intervals. At a neighboring position to the respective paper feeding rollers 61 to 65 on the paper feeding path 54, first, second, third, fourth, and fifth jamming detecting sensors 91, 92, 93, 94, and 95 are installed.

Meanwhile, as shown in FIG. 2, the pickup roller assemblies 55, 56, and 57 and the first and second paper feeding rollers 61 and 62 arc selectively connected to a first driving motor 81 by multiple first clutches 71 to be selectively driven, while the third, fourth, and fifth paper feeding rollers 63, 64, and 65 are selectively connected to a second driving motor 82 by multiple second clutches 72 to be selectively driven.

According to the features of the present invention, the paper feed control method determines the delay in feeding paper by detecting the conveyance time of the paper conveyed along the paper feeding path, and adjusts and compensates the rotational speed of the paper feeding rollers when determining the paper feed delay.

Here, the respective jamming detecting sensors detect the feeding of the paper, while the microcomputer 100 determines the paper feed delay by comparing the detected paper feeding time with a preset paper feeding time. The rotational speed of the paper feeding rollers are adjusted by varying the rotational speed of the first and second driving motors 81 and 82, which drive the paper feeding rollers.

Since the varied rotational speed of the first driving motor 81 may affect the papers which are being picked up from the cassettes, it is preferable to vary the rotational speed of the second driving motor 82 for less possibility of errors. Accordingly, in the present invention, the paper arrival time is measured right after the driving of the clutch of the first paper feeding roller 61 till the paper arrives at the third jamming detecting sensor 93, while the rotational speed of second driving motor is varied in accordance with the paper feeding delay to adjust the rotational speed of the third and fourth paper feeding rollers 63 and 64 thereby compensating for the paper feed delay.

The paper feed control method of the present invention will be described in greater detail with reference to FIG. 4. Here, since steps S201 to S205 also included in the description of FIG. 3 have already been described, their descriptions will be omitted.

After steps S201–S205, the microcomputer 100 measures the paper feed time taken for the paper to pass the first and second detecting sensors 91 and 92 to reach the third jamming detecting sensor 93 (Step S206), and determines whether the paper reaches the third jamming detecting sensor 93 within the preset time based on the detected paper feed time (Step S207).

If it is determined that the paper does not reach the third jamming detecting sensor within the preset time of step S207, it is determined whether the detected paper feed time is within a predetermined error range or not (S231). Here, the predetermined error range is the range pre-stored in the microcomputer 100, which is determined by considering the maximum rotational speed of the second driving motor 82 and the distance between the third and fifth jamming detecting sensors 93 and 95.

When the detected paper feed time is not within the predetermined error range, the paper feed is stopped (Step S221), and a jamming error message such as JAM ERROR is displayed (Step S222). Then the user removes the jammed paper (Step S223), and the printing job is re-started.

When the detected paper feed time is within the predetermined error range, the rotational speed of the second driving motor 82 is adjusted to increase or decrease the paper feeding rollers which are being driven by the second driving motor 82 so that the paper may reach the fifth paper feeding roller within the predetermined time. In other words, the paper feed delay is compensated within a certain error range, so that jamming can be prevented.

In the paper feeding device employing the paper feed control method of the present invention, the initial rotational speed of the second driving motor 82 is 640 pps (pulses per second), or 81.42 mm/sec (millimeters per second), and the distance from the third jamming detecting sensor 93 to the fifth jamming detecting sensor 95 is 98 mm, and 20 mm is set as the maximum error range in which the paper feed delay can be compensated. Accordingly, it takes the paper 1.203 seconds to reach the fifth jamming detecting sensor 95 when the driving motor is driven at a speed of 640 pps, and the paper feeding time corresponding to the compensatory maximum error range becomes 0.245 seconds.

In the above case, the compensation for the paper feed delay is performed as follows. When the paper feed delay is detected as 20 mm, which is the maximum allowable value of the error range by the third jamming detecting sensor 93, the paper should be fed from the third jamming detecting sensor 93 to the fifth jamming detecting sensor 95 within 0.96 seconds (1.203 seconds−0.245 seconds) so as to reach the fifth paper feeding roller 65 within the preset time. For this purpose, the rotational speed of the second driving motor 82 should be 802 pps (98 mm/0.96 sec=102 mm/sec), and accordingly, the rotational speed of the second driving motor 82 is increased by 16 or 17 pps ((802 pps−640 pps)/10=16.2 pps) for every paper feed delay by 2 mm.

After that, the microcomputer 100 detects the arrival time of the paper which is fed at the compensated speed of step S232 to the fifth jamming detecting sensor 95 (Step S233), and compares the detected arrival time with the preset time (Step S234). If it is determined that the paper feed is delayed, the microcomputer 100 stops the paper feed (Step S221) and displays the jamming error message (Step S222). Then as the user removes the jam, the printing job restarts (Step S223). Meanwhile, if a normal paper feed is carried out without any delay, the rotational speed of the second driving motor 82 is reset as its initial rotational speed (Step S235) for the next paper feed.

Meanwhile, if the paper is normally fed in step S207, the microcomputer 100 detects the paper arrival time to the fifth jamming detecting sensor 95 (Step S208), then determines whether the paper arrives within the preset time (Step S209). If the paper is normally fed, the next paper feed is readied, while if the paper feed is delayed, the paper feed is stopped (Step S221) then the jamming error is displayed (Step S222). These processes are actually not needed because the paper feed speed is compensated in the previous steps when the paper delay is determined.

According to the present invention, as described above, since the rotational speed of the paper feeding rollers is compensated to be increased appropriately according to the paper delay when there is a paper delay detected, the frequency of paper jamming at the fifth paper feeding rollers can be decreased. Therefore, the frequent interruption of the printing job which is caused in the conventional printing device due to the frequent paper jammings can be prevented.

Moreover, since the paper delay is compensated within a certain error range, the steady curl of the paper at the fifth paper feeding rollers can be controlled. In the case of continuous printing of the letter paper, since three sheets of letter paper can be maintained at uniform intervals while being simultaneously fed on the paper feed path, the deterioration of the print quality can be prevented.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A paper feed control method of a printing device, comprising the steps of:

picking a sheet of printable medium from a cassette and forwarding said printable medium to a feeding path formed between said cassette and a transfer unit of the printing device, said transfer unit conveying an image from a photosensitive medium to said printable medium;

feeding said printable medium forward to said feeding path;

detecting a feeding speed of said printable medium along said feeding path;

determining whether said printable medium is delayed or not in accordance with the result of said step of detecting the feeding speed; and compensating the feeding speed of said printable medium when said printable medium is determined to be delayed, the delay being within a predetermined range, the predetermined range determined according to a maximum feeding speed of said printing device.

2. The method of claim 1, with said step of determining whether said printable medium is delayed, further comprising the steps of:

setting a predetermined value of the feeding speed;

comparing the feeding speed with said predetermined value; and determining said printable medium being delayed when the feeding speed is less than said predetermined value.

3. The method of claim 1, with said compensating of the feeding speed being an increase of the speed of a motor driving a feeding roller, said feeding roller transporting said printable medium forward along said feeding path.

4. A paper feed control method of a printing device, comprising the steps of:

picking a sheet of printable medium from a cassette and forwarding said printable medium to a feeding path formed between said cassette and a transfer unit of the printing device, said transfer unit conveying an image from a photosensitive medium to said printable medium;

feeding said printable medium forward to said feeding path;

detecting a feeding speed of said printable medium along said feeding path;

determining whether said printable medium is delayed or not in accordance with the result of said step of detecting the feeding speed; and compensating the feeding speed of said printable medium by increasing the feeding speed from an initial value when said printable medium is determined to be delayed;

with the delay being within a predetermined range, the predetermined range determined according to a maximum feeding speed of said printing device.

5. A paper feed control method of a printing device, comprising the steps of: picking a sheet of printable medium from a cassette and forwarding said printable medium to a feeding path formed between said cassette and a transfer unit of the printing device, said transfer unit conveying an image from a photosensitive medium to said printable medium;

feeding said printable medium forward to said feeding path;

detecting a feeding speed of said printable medium along said feeding path;

determining whether said printable medium is delayed or not in accordance with the result of said step of detecting the feeding speed;

compensating the feeding speed of said printable medium by increasing the feeding speed from an initial value when said printable medium is determined to be delayed;

detecting on a point adjacent to said transfer unit, a second feeding speed of said printable medium along said feeding path;

determining whether said printable medium is delayed or not in accordance with the result of said step of detecting the second feeding speed; and resetting the second feeding speed of said printable medium to said initial value when said printable medium is determined to not be delayed according to said detection of the second feeding speed.

6. A paper feed control method of a printing device, comprising the steps of:

picking a sheet of printable medium from a cassette and forwarding said printable medium to a feeding path formed between said cassette and a transfer unit of the printing device, said transfer unit conveying an image from a photosensitive medium to said printable medium;

feeding said printable medium forward to said feeding path;

detecting a feeding speed of said printable medium along said feeding path;

determining whether said printable medium is delayed or not in accordance with the result of said step of detecting the feeding speed;

compensating the feeding speed of said printable medium by increasing the feeding speed from an initial value when said printable medium is determined to be delayed; and stopping said printable medium along said feeding path when said printable medium is determined to be delayed beyond a predetermined range.

7. A paper feeding control method of a liquid electrophotographic color printing device, comprising the steps of:

detecting a feeding speed of a printable medium being passed through a first, second, third, fourth, and fifth feeding rollers respectively by a first, second, third, fourth, and fifth jamming detecting sensors, said feeding rollers arranged in pairs at certain intervals on a feeding path of said printable medium, said feeding rollers transporting said printable medium through the feeding path, said jamming detecting sensors installed adjacent to the respective feeding rollers;

determining the presence of a delay in feeding said printable medium in accordance with said step of detecting the feeding speed; and compensating the feeding delay by adjusting a rotational speed of said feeding rollers when determining the feeding delay.

8. The method of claim 7, with said step of detecting the feeding speed by measuring a time after a driving of said first feeding roller until said printable medium arriving at said third jamming detecting sensor.

9. The method of claim 8, with said step of determining the presence of the delay when said printable medium arrival time at a certain part of the feeding path being later than a preset printable medium feeding time for the certain part by comparing the paper arrival time at the certain part detected by said third jamming detecting sensor with the preset paper feeding time for the certain part.

10. The method of claim 8, with said step of compensating the feeding delay adjusts a rotational speed of a driving motor to vary the rotational speed of said feeding rollers, said feeding rollers being driven by said driving motor.

11. The method of claim 10, further comprising the step of returning the adjusted rotational speed of said driving motor to an initial rotational speed after driving said driving motor at the adjusted rotational speed for a certain period of time.

12. The method of claim 11, with the rotational speed of said driving motor returning to the initial rotational speed when the paper is detected by said fifth jamming detecting sensor.

13. The method of claim 11, with the rotational speed of said driving motor being varied in accordance with the delay, said driving motor compensating the delay by adjusting the rotational speed of said third and fourth feeding rollers.

14. A method, comprising the steps of:

determining a first time period of a printable medium feeding from a first sensor to a second sensor located on a feeding path of a printing device;

setting an error range and storing in a microcomputer of said printing device;

comparing the first time period with said error range;

stopping the feeding of said printable medium when the first time period is not within said error range; and adjusting a rotational speed of a motor when the first time period is within said error range, said motor driving a first roller feeding said printable medium through the feeding path.

15. A method, comprising the steps of:

determining a first time period of a printable medium feeding from a first sensor to a second sensor located on a feeding path of a printing device;

setting an error range and storing in a microcomputer of said printing device;

comparing the first time period with said error range;

stopping the feeding of said printable medium when the first time period is not within said error range; and adjusting a rotational speed of a motor when the first time period is within said error range, said motor driving a first roller feeding said printable medium through the feeding path;

with said setting said error range according to a maximum rotational speed of said motor and a distance between a first point and a second point on the feeding path of said printing device.

16. The method of claim 15, with said first point being said second sensor and said second point being a third sensor adjacent to a transfer unit, the transfer unit accommodating a transfer of an image from a photosensitive medium onto said printable medium.

17. The method of claim 16, further comprising the steps of:

detecting a second time period between said second sensor and said third sensor on the feeding path;

comparing the second time period with a second predetermined time period;

stopping said printable medium from feeding through the feeding path when the second time period exceeds the second predetermined time period; and resetting the rotational speed of said motor to an initial rotational speed, said motor controlling the feeding speed of said printable medium through the feeding path.

18. A paper feeding apparatus of a liquid electrophotographic color printing device, comprising:

a cassette accommodating various sizes and types of printable medium;

a pickup roller assembly selecting a sheet of printable medium from said cassette and forwarding said printable medium to a feeding path;

a first, second, third, fourth, and fifth feeding rollers arranged in pairs at certain intervals on the feeding path, said feeding rollers transporting the printable medium through the feeding path;

a first motor driving said pickup roller assembly, said first feeding roller, and said second feeding roller;

a second motor driving said third, fourth, and fifth feeding rollers;

a first clutch selectively connecting said first driving motor with said pickup roller assembly, said first feeding roller, or said second feeding roller;

a second clutch selectively connecting said second motor with said third feeding roller, said fourth feeding roller, or said fifth feeding roller;

a first, a second, a third, a fourth, and a fifth sensors detecting a jamming of said printable medium, respectively installed adjacent to said first, second, third, fourth, and fifth paper feeding rollers, detecting said printable medium passing through said feeding rollers, said apparatus detecting the feeding speed of said printable medium being passed through the respective paper feeding rollers by the first through the fifth sensors; and a microcomputer controlling said first and second motors according to the data received from said sensors, said microcomputer determining a presence of a delay according to the detected feeding speed, said microcomputer compensating the feeding delay of the printable medium by adjusting a rotational speed of said feeding rollers through the control of said second motor according to the determined delay.

19. The apparatus of claim 18, with said microcomputer compensating the feeding delay by varying a rotational speed of said third and fourth feeding rollers when said printable medium does not arrive at said third sensor within a predetermined time period range.

20. The apparatus of claim 18, further comprising:

a photosensitive belt forming a closed loop and circulating an image developed on a developing unit; and a transfer unit conveying the developed image from said photosensitive belt to said printable medium, said fifth sensor and fifth roller being adjacent to said transfer unit, said microcomputer resetting the rotational speed of the fifth roller to an initial rotational speed when the fifth sensor detects said printable medium and said microprocessor determines no delay.

* * * * *